US006851198B1

(12) United States Patent
Harty

(10) Patent No.: US 6,851,198 B1
(45) Date of Patent: Feb. 8, 2005

(54) SUPERIOR SYSTEM AND METHOD FOR DETERMINING THE POSITION OF A FIRST DOWN OF A FOOTBALL ON A FIELD DURING A GAME

(76) Inventor: Norman D. Harty, 4312 Spanish Broom Ave. NW., Albuquerque, NM (US) 87120

( * ) Notice: Subject to any disclaimer, the term of this patent is extended or adjusted under 35 U.S.C. 154(b) by 0 days.

(21) Appl. No.: 10/650,586

(22) Filed: Aug. 28, 2003

Related U.S. Application Data

(60) Provisional application No. 60/407,111, filed on Aug. 30, 2002.

(51) Int. Cl.[7] ..... G01B 11/26; G01C 15/00

(52) U.S. Cl. ..... 33/289

(58) Field of Search ..... 33/289, 227, 263, 33/DIG. 21, 286

(56) References Cited

U.S. PATENT DOCUMENTS 3,300,861 A * 1/1967 Lilly ..... 33/289
3,482,317 A * 12/1969 Truax ..... 33/289
3,738,014 A * 6/1973 Sproul, Sr. ..... 33/289
3,752,588 A 8/1973 Chapman ..... 33/289
3,985,356 A 10/1976 Carlock ..... 33/289
4,090,708 A 5/1978 McPeak ..... 33/289
4,232,450 A * 11/1980 Lynn ..... 33/289
5,067,245 A * 11/1991 Millard ..... 33/289
5,113,589 A * 5/1992 Randolph ..... 33/289
5,214,491 A 5/1993 Snowden ..... 33/289

* cited by examiner

*Primary Examiner*—Christopher W. Fulton
(74) *Attorney, Agent, or Firm*—Roberts Abokhair & Mardula, LLC

(57) ABSTRACT

Measuring the required distance necessary for a first down in the sport of football. The apparatus includes a ten yard marker pole with an attached laser apparatus. The laser apparatus emits light in the blue-green wavelength and is capable of emitting laser beam across the entire width of the field onto a target, to aid an official in determining if a first down has occurred or not.

5 Claims, 9 Drawing Sheets

SUPERIOR SYSTEM AND METHOD FOR DETERMINING THE POSITION OF A FIRST DOWN OF A FOOTBALL ON A FIELD DURING A GAME

CROSS REFERENCE TO RELATED APPLICATION

This application claims benefit under 35 U.S.C. § 119(e) of provisional application No. 60/407,111, filed Aug. 30, 2002, which is incorporated by reference herein, in its entirety, for all purposes.

BACKGROUND OF THE INVENTION

The present invention relates generally to the field of laser measuring or marking devises. The present invention provides a laser apparatus that projects a laser beam over a distance and onto a target as a means of delineating a predetermined length and a method for measuring whether an object has traveled a predetermined length using the laser apparatus.

In the game of football, an offensive team that advances the ball the length of ten yards within four plays makes a first down and retains possession of the ball. The traditional method of measuring a first down or determining the distance yet to be covered to make a first down relies on a set of markers connected by a chain that stretches ten yards. The back marker pole, known as the scrimmage marker, designates the starting point from which to measure a first down. The forward marker pole, known as the first down marker, is stretched against the length of the chain and designates the length of the field over which the offensive team must carry the ball in order to make a first down.

Throughout the game, football officials must resort to the traditional first down markers kept on the sideline to establish whether the offensive team has carried the ball the required distance. In situations where the football is located in the middle of the field, which is 53 yards wide, the first down markers must be moved onto the field for the measurement causing the game to be stopped. This increases the time it takes to complete a game.

The current first down measuring method can be inaccurate. During play, the first down markers remain on the sideline with the scrimmage marker designating the position of the ball at the beginning of the previous first down. In moving the markers onto the field to obtain a measurement of the ball after the play has ended, errors are introduced by forward or backward shifts of the markers relative to their first down positions on the sideline. Since the difference between making a first down and not could be a fraction of an inch, any variation in the position of the first down markers on the field versus the first down markers on the sideline is critical. In addition, the current measuring method causes many delays in the play of the game.

SUMMARY OF THE INVENTION

The advantages, purposes and objects of the present invention will be set forth in part in the description which follows, and in part will be evident from the description, or may be learned by practice of the invention. The advantages, purposes and objects of the invention will be realized and attained by the elements and combinations particularly pointed out in the appended claims.

It is an object of the present invention to improve the game of football by increasing the accuracy and precision of the measurement for determining first downs.

It is another object of the present invention to decrease time delay between plays caused by running first down markers onto the field when measuring for a first down.

The laser apparatus described herein emits a beam of visible light to a distance of at least 200 yards. The laser beam is projected over the ground as a reference mark for measuring position of an object at a distance. The laser reference mark is projected onto a distant target. The laser reference mark is detected by an optical device or the human eye such that an individual or one or more devices can quickly and accurately ascertain whether any portion of the object to be measured has crossed the laser reference line.

The present invention may be embodied as a laser apparatus attached to a portable measuring unit located at a distance from the object to be measured, and as a method for using the laser apparatus in combination with the portable measuring unit to determine whether the object has crossed the laser reference line. The method is accurate and instantaneous.

The present invention provides an improved system and method for measuring first downs on a football field using a laser apparatus and a target in combination with first down marker poles.

Other objects and advantages of the present invention will become apparent to those of ordinary skill in the art combining references to the following specification together with the drawings.

The system and method described herein provides a more accurate means of measuring first downs and will decrease the delays between plays due to running the first down chains and markers onto the field. In addition, the present invention aids officials in returning the ball after incomplete plays to the point of origination and provides an accurate reference mark from which to assess penalties.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention.

DETAILED DESCRIPTION

Reference will now be made in detail to the presently preferred embodiment of the invention, an example of which is illustrated in the accompanying drawings.

Figure 1:
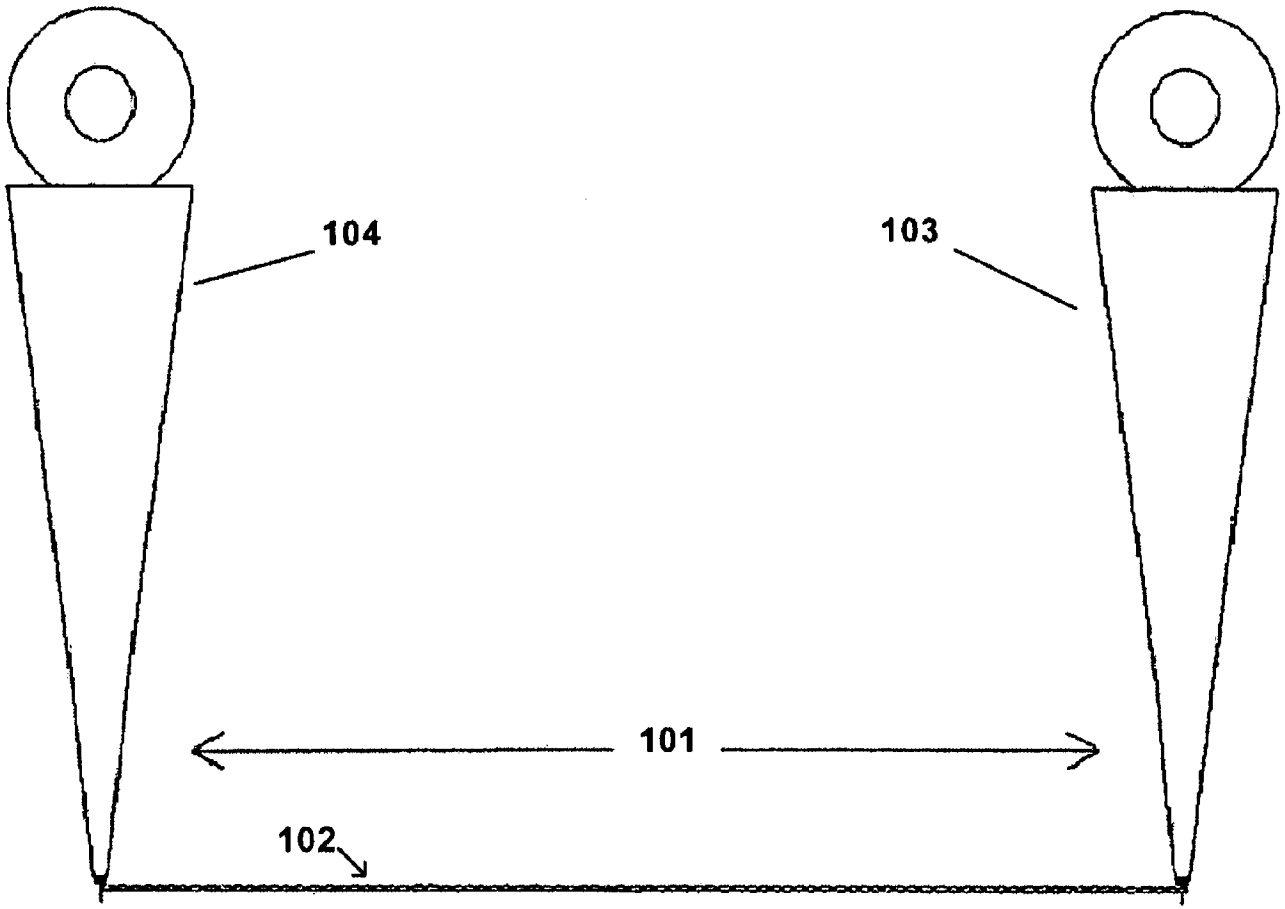
FIG. 1 Prior Art
FIG. 1 illustrates an example of first down markers conventionally used to measure the ten yard distance required for a first down.

Referring to FIG. 1, a view of the current markers 101 used in football games including the chains 102 used to mark the distance of ten yards for first downs, is illustrated. When the chains are stretched between the forward first down marker pole 103 and the scrimmage marker pole 104 the markers measure a distance of ten yards.

Figure 2:
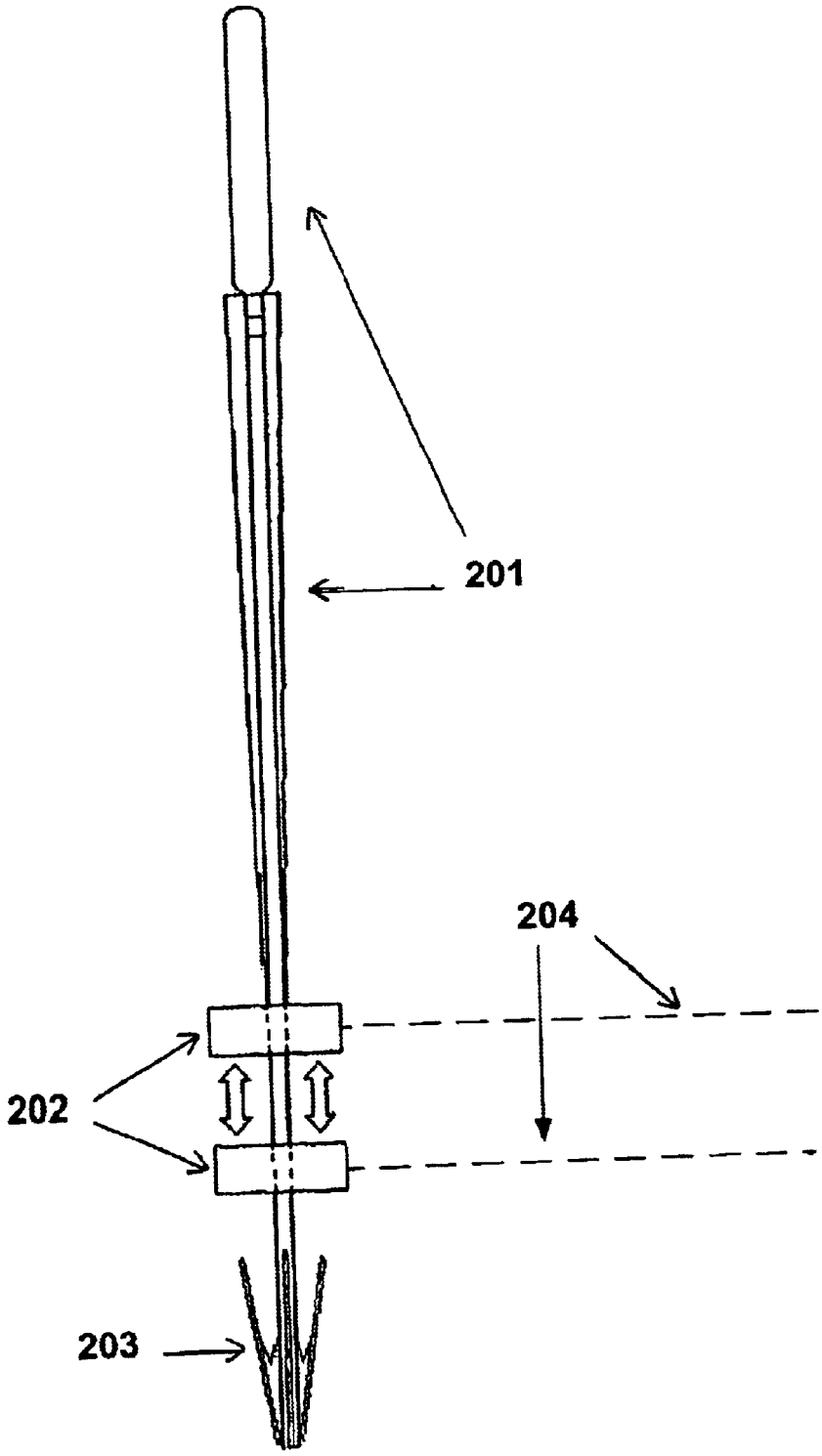
FIG. 2 illustrates a side view of the forward first down marker pole with a laser apparatus attached according to one embodiment of the present invention.

Referring to FIG. 2, a side view of a laser apparatus 202 adjustably attached (as indicated by arrows) to a first down marker pole 201 is illustrated. When in use, the first down marker pole 201 is kept at a right angle to the field through the stabilizer legs 203. The stabilizer legs 203 assist in maintaining the poles at a 90° angle to the field when extended and placed on top of the sideline demarcation of the field. A laser beam 204 is emitted by a laser (not shown) housed inside the laser apparatus 202. The laser beam 204 is projected above the field and onto a target for rapid visualization of the first down distance and aids a viewer in assessing whether the object to be measured has traveled the first down distance. The laser apparatus 202 is adjustably connected to the marker pole 201, with arrows indicating movement between adjustment positions along the marker pole 201.

Figure 3:
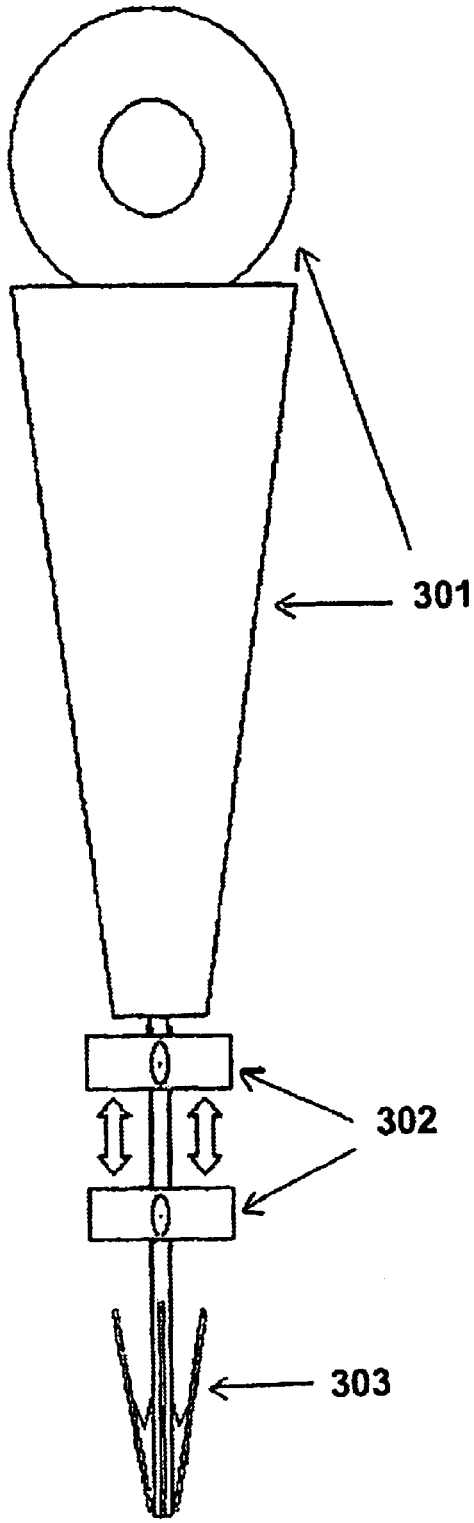
FIG. 3 illustrates a front view of a forward first down marker and laser apparatus having an adjustable means for vertically positioning a laser apparatus along the length of a forward first down marker according to one embodiment of the present invention.

Referring to FIG. 3, a front view of an embodiment of the present invention is illustrated. In this embodiment, a laser apparatus 302 is adjustably positioned on the forward first down marker 301 such that the light emitted is capable of projecting a beam across a football field to the far sideline from where the forward first down marker is located. The trajectory of the path of the beam perpendicularly intersects the far sideline demarcation line. Attachment of the laser apparatus to the first down marker may be through a fixed or adjustable mechanism. Stabilizers 303 assist in stabilizing the first down marker pole 301 in the vertical position relative to the field.

Figure 4:
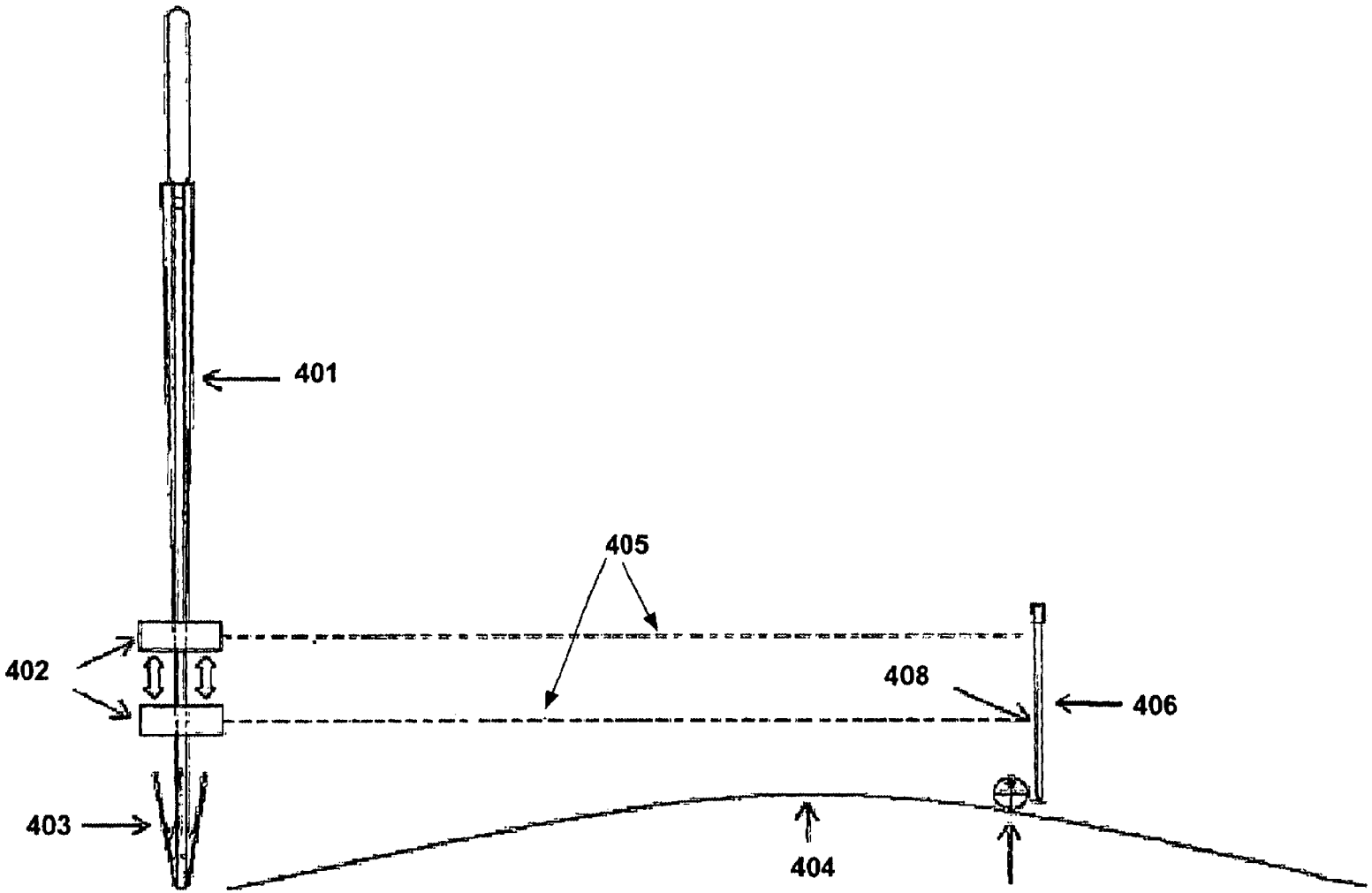
FIG. 4 illustrates a side view of the first down marker with a laser apparatus adjustable along the length of the forward first down marker pole to account for rises and troughs present in a football field according to one embodiment of the present invention.

Referring to FIG. 4, a side view of one embodiment of the present invention illustrates the adjustability of the laser measuring device 402 along the vertical axis of the forward first down marker pole 401. The laser measuring device 402 will slide along the vertical axis of the first down marker to compensate for fields that have a slope or "crown" 404 of varying sizes. In addition, an alternate embodiment of the present invention will be equipped with plural leveling means 403 along the horizontal and vertical axis to keep the laser devise perpendicular with the football field at a 90° angle with the sideline. Leveling means may include a bubble level, a plate, a pendulum, or a plumb bob, but are not limited thereto. A laser beam 405 is projected above the slope of the field 404 and onto a target 406 positioned near an object 407 whose position is to be measure. The image on the target made by the laser 408 is easily detected by an image detector or by an observer.

Figure 5:
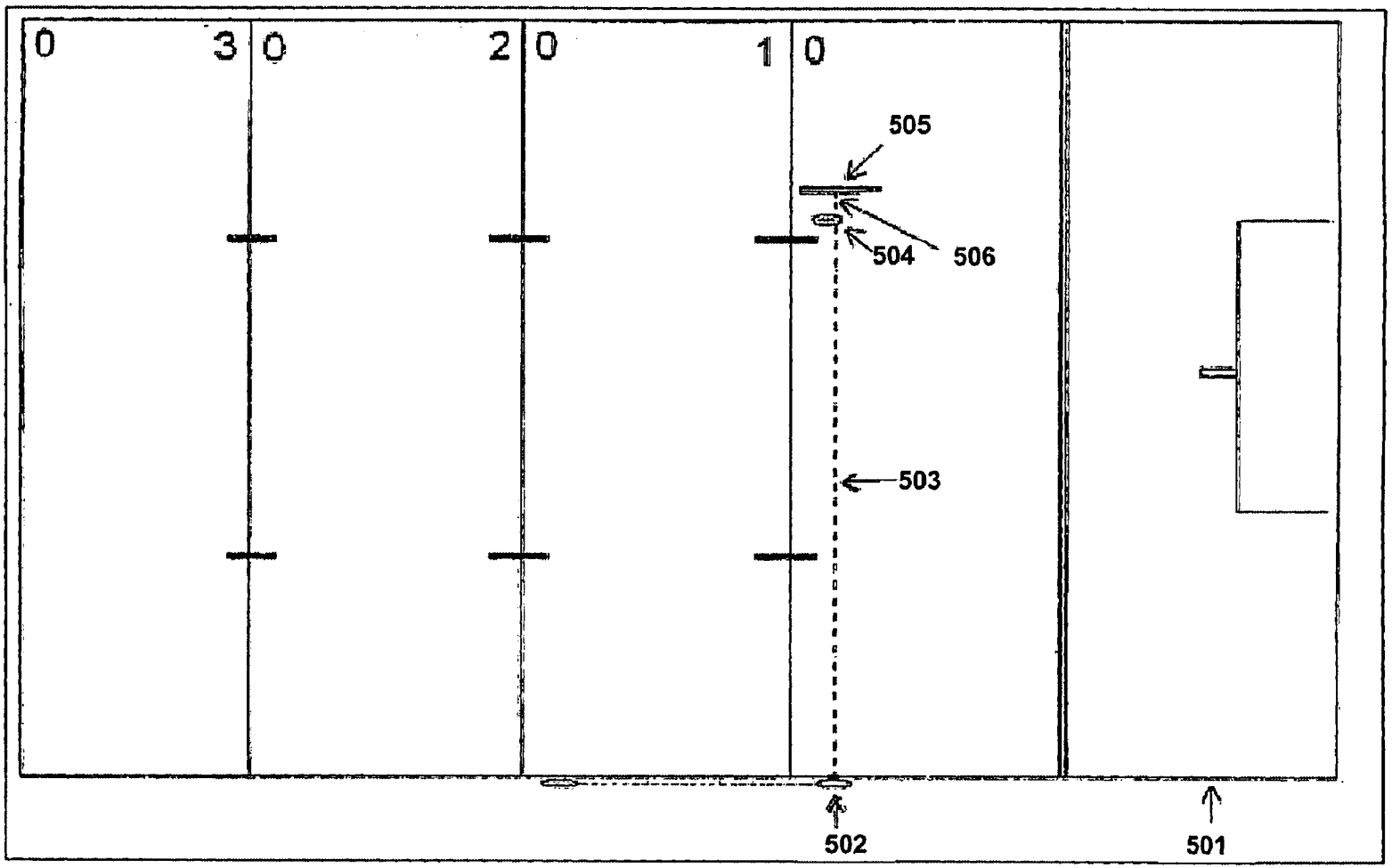
FIG. 5 illustrates a top view of a laser apparatus emitting a laser beam reference line that is intercepted by a target according to one embodiment of the present invention.

Referring to FIG. 5, a top view of an embodiment of the present invention where a football 504 is located between a laser measuring device 502 located on the sideline of a football field 501 and target 505 is illustrated. The beam 503 is projected over the field and onto a target 505 and appears as a line 506 located near a football 504. According to one embodiment of the present invention, the laser is a green beam laser emitting at a wavelength of about 532 nm. According to another embodiment of the present invention the target is collapsible.

The human eye is the most sensitive to light in the blue-green wavelength area of the visible spectrum. The visibility of laser light in the blue-green spectra (approx. 424 nm to 575 nm) is about seven times higher than the visibility of lasers with the same output power that emit in the red wavelenth range (approx. 647 nm to 700 nm). Positioning and projecting lasers in the blue-green spectra can be seen well for up to 600 feet without need to resort to high power devices. Because of these properties, projections of blue-green light with far higher brightness can be achieved by still remaining in laser class 2 or 3A or lower.

According to one embodiment of the present invention, a laser apparatus emits light in the blue-green spectra. The present invention may be embodied using a laser apparatus that emits light in the range of wavelengths from about 450 nm to about 500 nm.

The present invention may also be embodied using a laser apparatus that emits light in the range of wavelengths from about 500 nm to about 550 nm, to which the human eye is particularly sensitive.

According to an exemplary embodiment of the present invention, a laser is implemented in the apparatus that emits light at about 532 nm.

Figure 6:
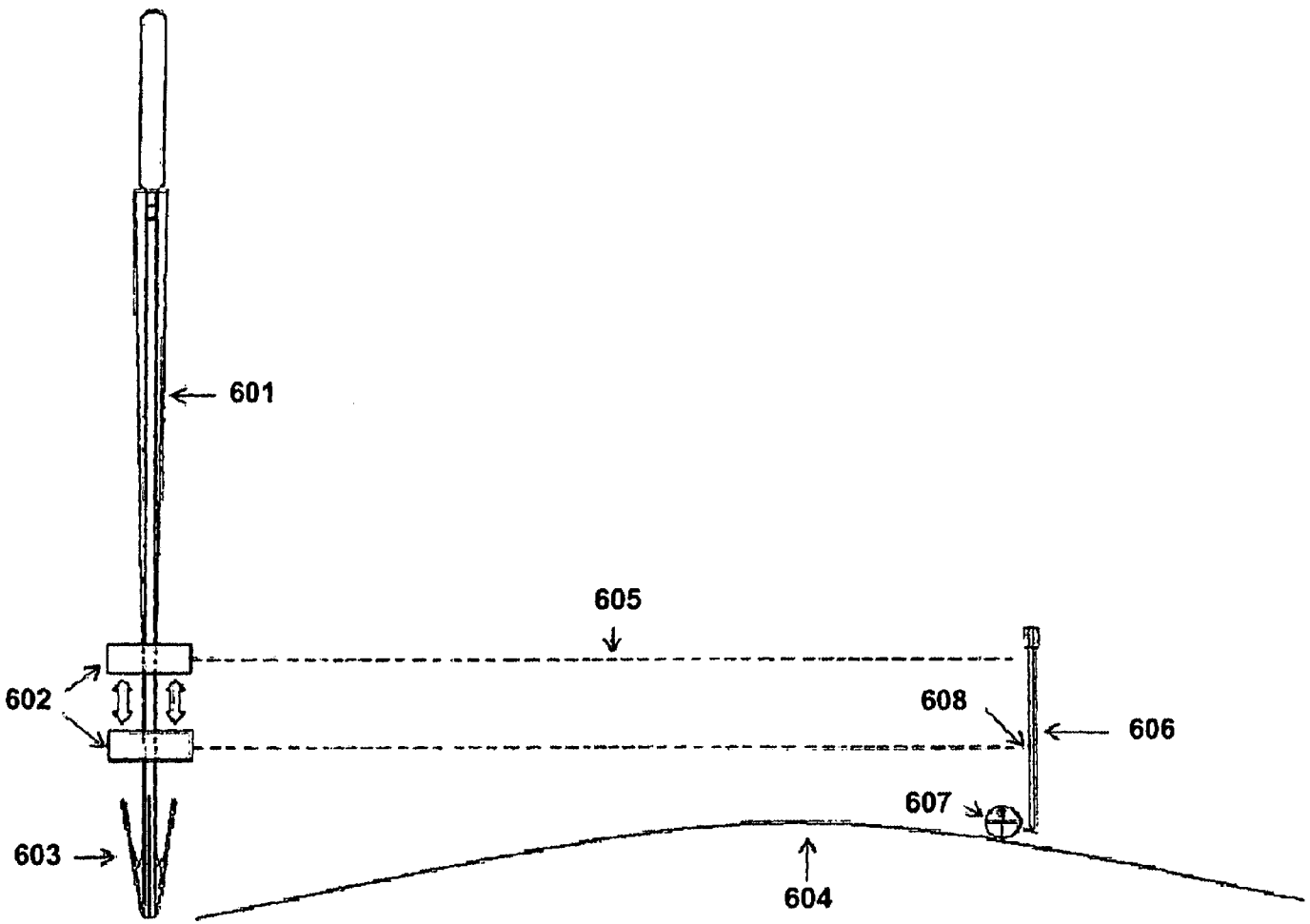
FIG. 6 illustrates a side view of a laser apparatus with a beam shaper to emit a beam that is projected onto a target as a line with the football in the foreground according to one embodiment of the present invention.

Referring to FIG. 6, a side view of one embodiment of the present invention with a target 606 being located on the far side of an object, for example, a football 607. In this embodiment, a beam shaper is located within or near a laser apparatus 602 and shapes the laser beam to appear as a vertical line 608 projected onto a target 606 on the far side of the football 607. One or more stabilizer legs 603 stabilize the first down marker pole 601 containing the laser apparatus 602 in relation to the mark on the sideline that runs the length of the field and are located on each side of the field thereby ensuring the laser beam 605 projected onto the target on the field faithfully duplicates the first down position of the pole located on the sideline. To accommodate the slope of any field 604, the laser apparatus 602, can be adjusted vertically along the first down marker pole 601. According to an additional embodiment, a target is located on the opposing sideline.

Figure 7:
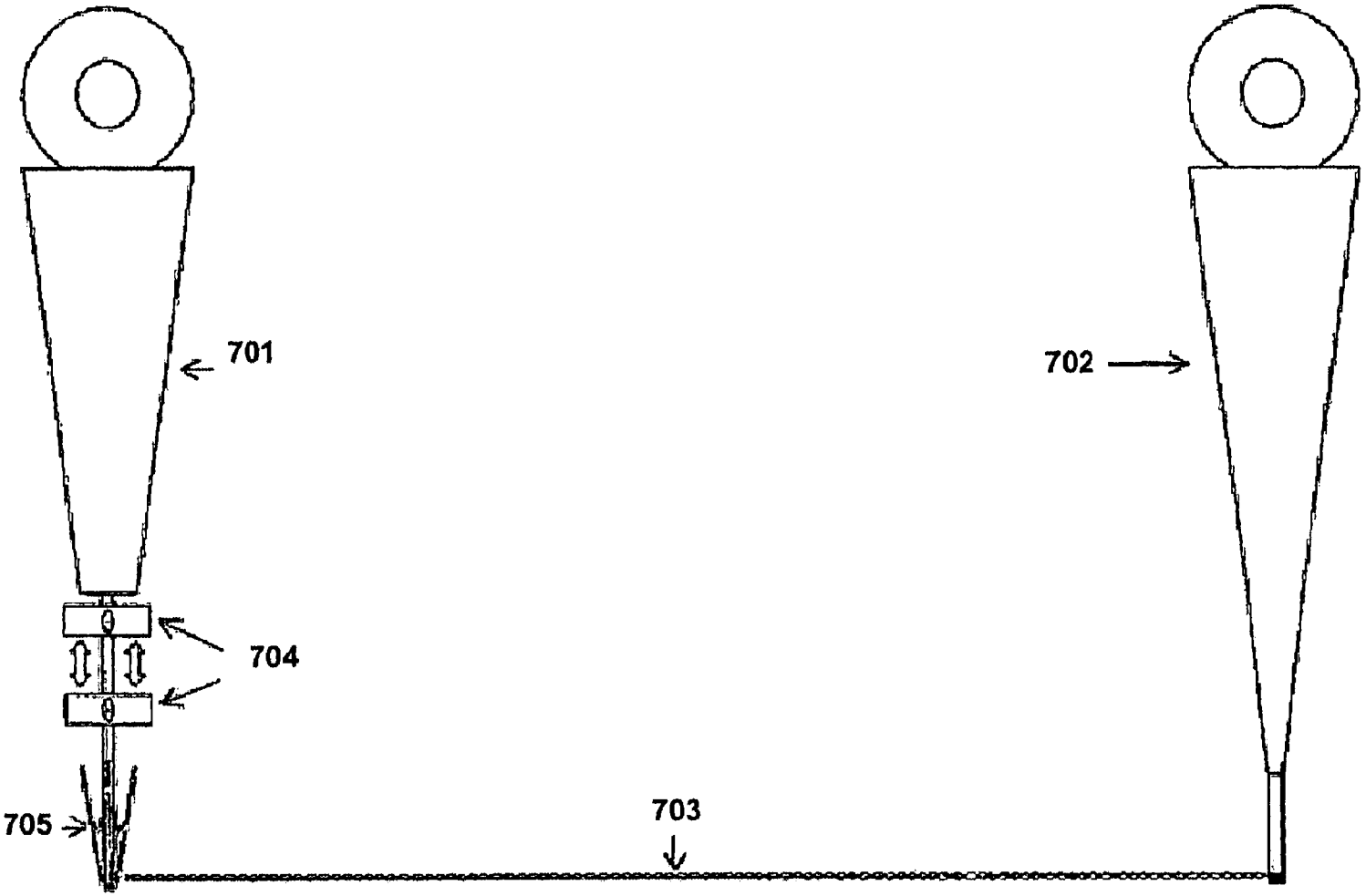
FIG. 7 illustrates a front view of a laser apparatus adjustably attached to the forward first down marker pole, according to one embodiment of the present invention.

Referring to FIG. 7, a front view of the laser apparatus 704 adjustably attached to the forward first down marker pole 701 having stabilizers 705 positioned on the lower portion of the first down marker pole 701 is illustrated according to one embodiment of the present invention. Chains 703 connect the scrimmage marker pole 702 to the first down marker pole containing the laser apparatus.

Figure 8:
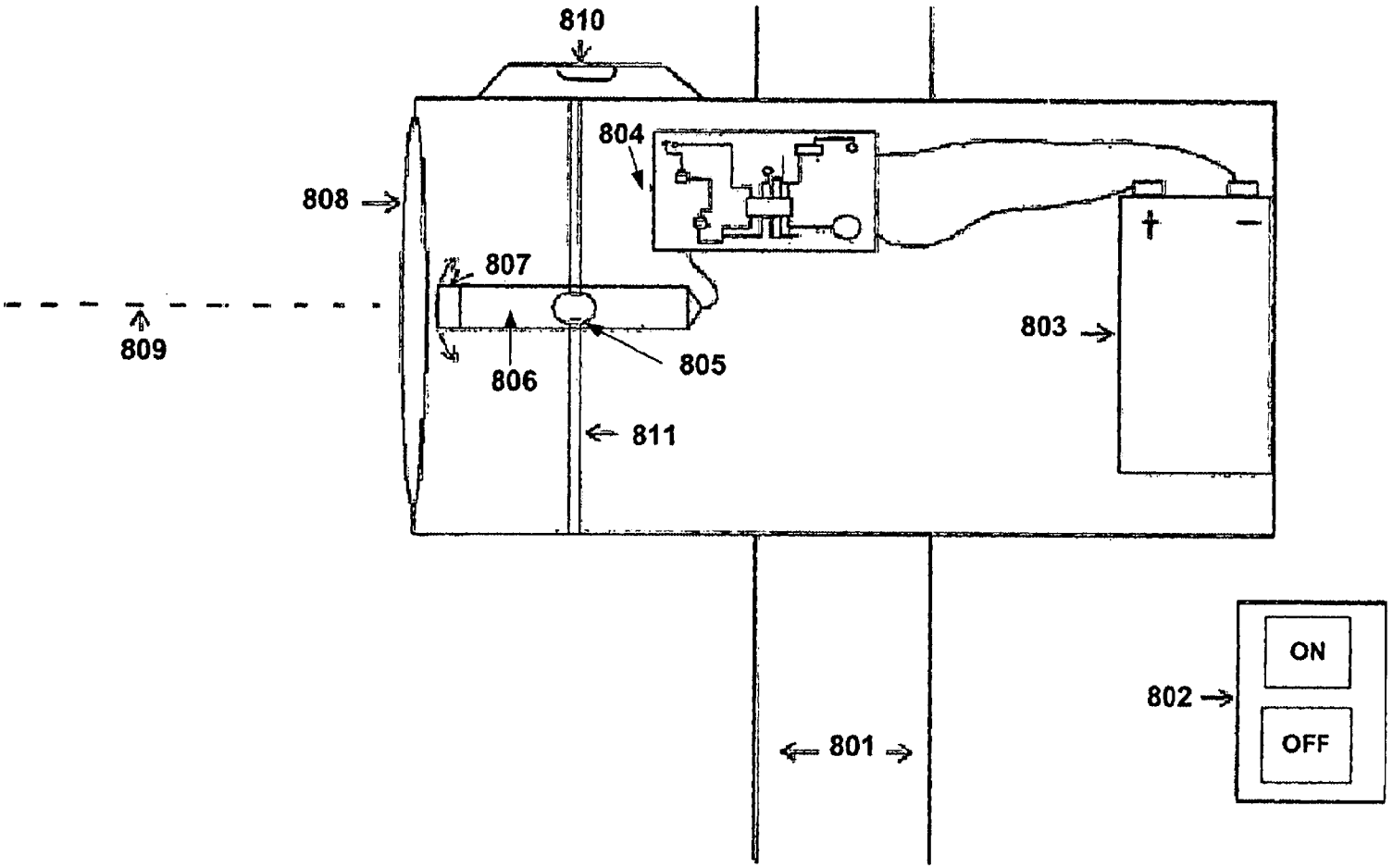
FIG. 8 illustrates a diagrammatic cross sectional view of the laser apparatus attached to a forward first down marker pole according to one embodiment of the present invention.

Referring to FIG. 8, a diagrammatic cross section of the laser apparatus is illustrated for one embodiment of the present invention. A cylindrical laser housing 806 is attached to a laser mounting bracket 811 of the laser apparatus which is supported by the marker pole 801. A swivel plate 805 moves the cylindrical laser housing 806 up and down repeatedly and at such a frequency to cause the laser beam 809 emitted from the open end of the laser apparatus 807 and projected onto a target located in front of the laser beam to appear as a line (not shown). The swivel plate 805 may be powered by a linear motor or a rotational motor. In an embodiment utilizing a rotational motor, the cylindrical laser housing is attached to a rocker arm that moves the housing up and down. The rocker arm may be oscillated by a motor-driven cam rotating at the desired frequency for oscillating the beam over a target in such a manner that the beam appears as a line when the beam is projected onto a target positioned in a range of from about 0 to at least 153 feet (i.e., the breadth of a football field) away from the laser apparatus.

Other beam shaping means for generating the appearance of a line projected onto a target include placing one or more diffraction gratings (or line generators) (not shown) in the path of a laser beam 809 at the open end of laser apparatus 807 thereby producing a row of dots appearing as a continuous line on a target when the target is positioned up to about 153 feet in from of the laser apparatus.

Additionally, cylindrical lens rotated to a 90 degree angle in front of the laser will expand the beam to form a line when the shaped beam is projected onto a target positioned at a distance of up to about 153 feet in front of the laser.

Yet another means of shaping a beam includes mounting a generator lens in front of cylindrical tube 806 containing laser (not shown), to project a line onto a target wherein the target is positioned in the range of up to about 153 feet in front of the beam origin.

The laser beam can be shaped by oscillations of a mirror mounting on an acoustic optic modulator in front of the laser thereby projecting a line onto a target when the target is positioned in the range of from about 0 to 153 feet in front of the beam origin.

Yet another beam shaping method includes mounting several optic lenses of different diopters at different angles in front of the beam thereby projecting a line onto a target wherein the target is positioned in the range of up to 153 feet in front of the beam. The lenses would be switched either manually at the laser box or by remote control for different distances on the field.

Yet another beam shaping method includes shaping the beam with an electro-optic beam deflector mounted in front of the laser to create a vertical line in the range of up to about 153 feet onto the target.

Still another way to shape the beam includes mounting a piezo-electric beam deflector in front of the beam thereby projecting a line onto a target wherein the target is positioned up to about 153 feet in front of the laser.

A power source 803, for example, a rechargeable battery, is connected to a circuit board 804. In one embodiment of the present invention circuit board 804 is connected to one or more motors that drives the up and down motion of the cylindrical laser housing 806. The power source 803 also powers the laser.

In yet another embodiment of the present invention, a laser apparatus can be controlled either manually or through remote control at 802. In still another embodiment, leveling means 810 is attached to the topside of the laser apparatus to help maintain the laser apparatus in a plane that is about parallel to the field. In one embodiment of the present invention, the leveling means is a bubble level. Plural leveling devices may be attached to the laser apparatus to further ensure the correct orientation of the apparatus during use. An optically transmissive lens cover 808 is placed over the end of the laser apparatus to protect the apparatus from weather without interfering with transmission of the laser beam.

The laser apparatus can be operated either manually or remotely. One embodiment of the present invention provides a remote control that turns the laser on and off and is controlled for example by a referee that is on the field.

Another embodiment of the present invention is to have a circuit board that is inside the laser box that controls the motor on the shaft that rocks the laser up and down. The circuit board may also control the remote control, the laser and the rechargeable battery.

Figure 9:
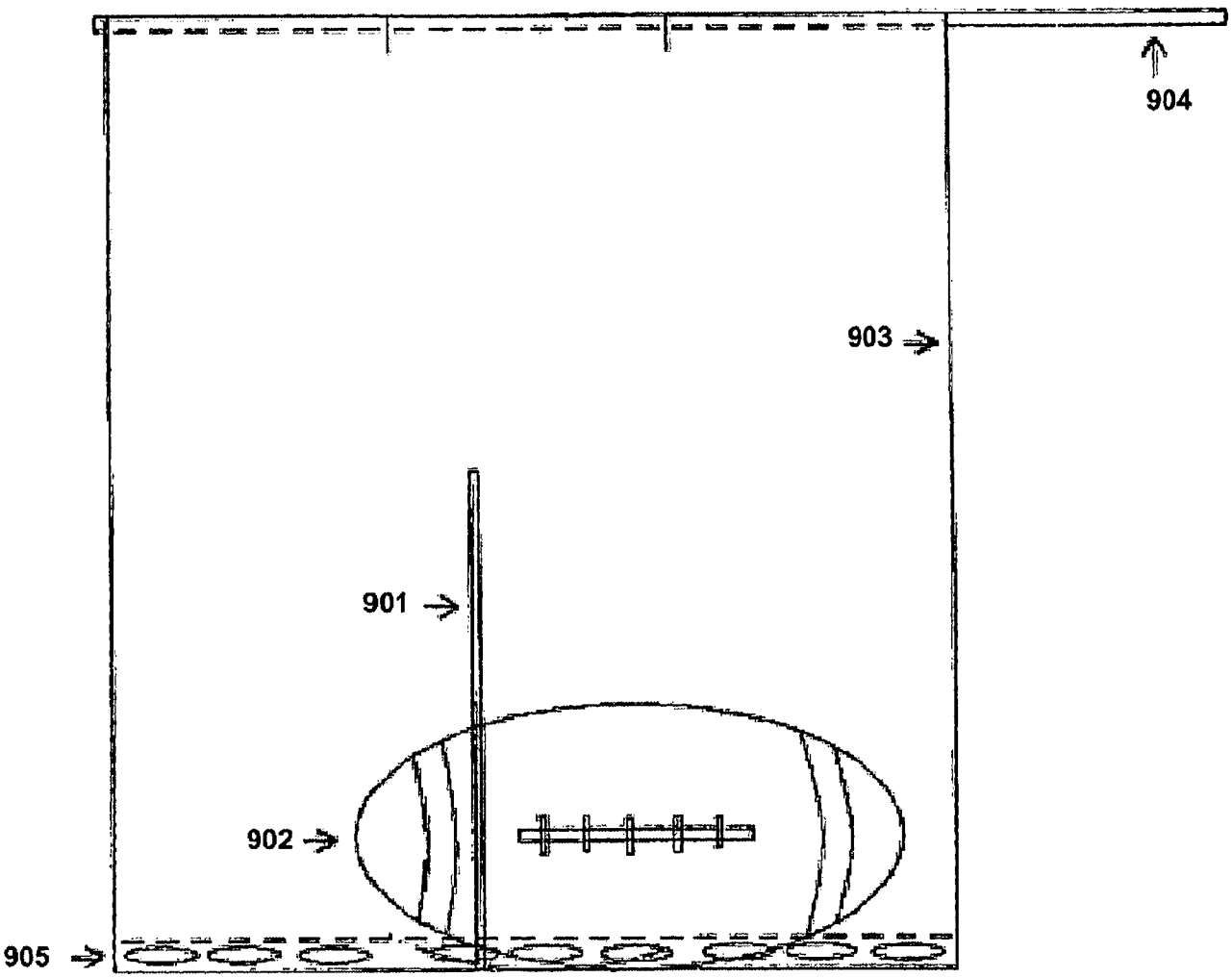
FIG. 9 illustrates a target positioned to intercept the laser line in relation to the object to be measured, for example a football.

Referring to FIG. 9, a close up view of the laser line projected upon a target with a football in the foreground is illustrated. A first down distance as represented by laser line 901 is projected on target 903. When football 902 is in the foreground between the laser and the target, the laser line will project upon both the target 903 and the football 902. When a first down is to be measured, the target 903 is positioned near the ball 902 and in the path of the laser beam line 901. A target 903 is held in position through a handle 904 and the laserline indicating the first down distance is projected onto a target. Whether the ball 902 has crossed the first down distance will be readily apparent from the placement of the laser line that falls either upon the ball or the target or both.

According to one embodiment of the present invention a target is made from a non-reflective material with dimensions of about 24–36 inches wide and between about 24–36 inches tall attached to a collapsible handle. In another embodiment the target may contain chemicals capable of emitting photons when stimulated by the laser (i.e., exhibiting fluoresecence). In yet another embodiment, a target may contain a weighted perimeter on one or more sides. A target may be semisolid, solid, paper, plastic, cloth, wood, metal or a combination thereof.

In another embodiment of the present invention, a laser apparatus is activated either manually or by an official on the field using remote control as is illustrated in FIG. 8. The position of the first down marker located on the sideline is faithfully reported to a target located on the field by projecting a laser beam originating from the laser apparatus attached to the first down marker pole located on the sideline. The laser beam is projected over the field and onto a target located near the ball. The first down distance as projected by the laser onto the target informs the observer if the object being measured, for example a football, has traveled the required distance as measured by the first down markers positioned on the sidelines of the field using the present invention. The position of the football in relation to the laser mark is readily apparent and can be perceived by an optical device or the human eye.

There are various mechanisms to ensure a laser apparatus projects a laser reference mark across the field at a right angle to the sideline. For additional information, refer to the method described in U.S. Pat. No. 3,752,588, which is incorporated by reference. Other means to ensure the laser reference mark projects at a right angle to the sideline may include but are not limited to one or more of the following embodiments.

In one embodiment of the present invention, one or more straight edge plates are mounted to the bottom portion of the first down marker pole containing the laser apparatus. The plates are aligned parallel with the sideline mark on the football field. In yet another embodiment, two or more stabilizers are attached to the ground end of the first down marker pole in such as manner that any three or more stabilizers form right angles one to the other with the first down marker pole located in the center. The straight edge plates and or stabilizers can be either stationary or collapsible. In one embodiment, one or more stabilizers are illustrated as collapsible legs.

In another embodiment, a magnetic compass is attached to a first down marker pole that supports a laser apparatus or is attached directly to a laser apparatus. A compass acts as a fiduciary whereby the compass heading that corresponds to the direction where the laser projects a beam perpendicular to the far sideline can be monitored and maintained. The compass acts to maintain this heading throughout the game and ensures that the laser reference mark accurately reflects the first down mark. The compass points directly across the field to the opposing sideline and the compass heading is registered. This heading is maintained throughout the game thereby ensuring perpendicularity with the sidelines Another embodiment of the present invention is directed to the use of Global Positioning Satellite (GPS) to ensure the proper alignment of the laser beam across the field.

Another embodiment of the present invention is to locate the first down marker pole with the laser apparatus attached on a track that runs parallel to the sideline. For further details of such a track system, refer to U.S. Pat. No. 3,985,356 which ensures that the laser is positioned perpendicular to the sideline. In addition a track system also ensures that a laser moves parallel to the sideline. U.S. Pat. No. 3,985,356 is incorporated herein by reference.

Another embodiment of the present invention is directed to the use of the laser beam itself to ensure the necessary alignment. The whole beam or a part thereof could be diverted to the side line using a beam splitter. The diverted beam is swept along the sideline or is focused on one or more fiducial targets located on or near the field to ensure the laser beam is projected across the field at a 90° angle. Alternatively, the whole beam or a part thereof is swept across the field in the direction of the opposing side to ensure perpendicularity of the mark with the sideline.

Another embodiment of the present invention is directed to the use of a reflecting system to ensure proper alignment of the laser beam across the field. A mirror is one type of reflecting material that could be placed in front of the laser to reflect the beam back upon itself. When a 90° angle is reached it would line up and reflect back at itself to a sensor. The amount of reflectance is measured and the alignment of the laser across the field is adjusted to the proper alignment.

Another embodiment of the present invention is directed to the use of a level system that would locate levels on one or more sides of the laser apparatus and or the first down pole to ensure proper alignment of laser across the field.

It will be apparent to those skilled in the art that various modifications and variations can be made in the system and method of the present invention and in correction of this measuring apparatus without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims.

What is claimed is:

1. An apparatus for projecting a laser beam onto a target from which to measure the position of a football on a football field, the apparatus comprising:

a laser emitting the laser beam, the laser beam having a wavelength in the range of from about 450 nm to about 550 nm;

means for shaping the beam;

a measuring device comprising a first down marker pole alienable on a sideline of the football field and a scrimmage pole connected by a chain wherein the laser is attached to the first down marker pole and is alienable at a 90° angle with the sideline; and a target positionable on a far side of the football;

wherein the laser beam emitted by the laser is projected over the football field toward the target such that a laser first down mark is orented near the football as a result of the laser beam being intercepted by the target.

2. The apparatus of claim 1, wherein the means for shaping the beam comprises a reciprocating member acting to move the beam back and forth to make the beam appear as a vertical line.

3. A method for promoting an accurate measurement of first downs comprising:

aligning a forward first down marker on a sideline of a football field;

positioning a laser apparatus attached to the forward first down marker at a 90 angle with the sideline;

positioning a target on the far side of the football;

projecting a laser beam over the field toward the target;

shaping the laser beam with the aid of a beam shaper;

intercepting the projected laser beam on the target thereby creating a laser first down mark near the football; and determining the position of the football relative to the laser first down mark on the target.

4. The method of claim 3, wherein shaping the laser beam comprises moving the beam back and forth to make the beam appear as a vertical line.

5. An apparatus for promoting an accurate measurement of first downs, the apparatus comprising:

means for aligning a forward first down marker on a sideline of a football field;

means for positioning a laser apparatus attached to the forward first down marker at a 90° angle with the sideline;

a target positionable on the far side of the football;

means for projecting a laser beam emitted from the laser apparatus over the field toward the target;

means for shaping the laser beam with the aid of a beam shaper;

means for intercepting the projected laser beam on the target thereby creating a laser first down mark near the football; and means for determining the position of the football relative to the laser first down mark on the target.

* * * * *